US006575563B1

(12) United States Patent
Cornell

(10) Patent No.: US 6,575,563 B1
(45) Date of Patent: Jun. 10, 2003

(54) POWER/VOLUME REGIME FOR INK JET PRINTERS

(75) Inventor: Robert Wilson Cornell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/212,497

(22) Filed: Aug. 5, 2002

(51) Int. Cl.[7] ..... B41J 2/05
(52) U.S. Cl. ..... 347/64
(58) Field of Search ..... 347/56, 62, 61, 347/63, 65, 64, 57–59

(56) References Cited

U.S. PATENT DOCUMENTS

| | | | | |
|---|---|---|---|---|
| 5,481,287 A | | 1/1996 | Tachihara | 347/62 |
| 6,132,030 A | * | 10/2000 | Cornell | 347/57 |
| 6,142,612 A | * | 11/2000 | Whitman | 347/63 |
| 6,213,587 B1 | | 4/2001 | Whitman | 347/47 |
| 6,234,612 B1 | | 5/2001 | Cornell et al. | 347/62 |

FOREIGN PATENT DOCUMENTS

| | | | |
|---|---|---|---|
| EP | 867286 A2 | 9/1998 | B41J/2/05 |

* cited by examiner

*Primary Examiner*—Huan Tran
*Assistant Examiner*—Juanita Stephens

(74) *Attorney, Agent, or Firm*—David LaRose; Jacqueline M. Daspit

(57) ABSTRACT

An ink jet printer forms printed images by ejecting droplets of ink onto a print medium at a stable velocity. The printer includes an ink jet print head having nozzles through which the droplets of ink are ejected. The print head includes a heater chip having heating elements, each of which is associated with a corresponding one of the nozzles. Each heating element transfers heat into adjacent ink at a predetermined rate sufficient to maintain the stable velocity of the droplets of ink, where the predetermined rate of heat transfer is accomplished when a predetermined minimum power level is applied to the heating element. Each heating element includes a heater resistor and a protective layer having a protective layer thickness. Each heater resistor has a heater resistor area and a heater resistor thickness, and is operable to provide a predetermined minimum power density per unit area when the predetermined minimum power level is applied. The heater resistor area multiplied by a sum of the heater resistor thickness and the protective layer thickness represents a heating element volume. Each heating element is operable to provide a predetermined minimum power density per unit volume within the heating element volume when the predetermined minimum power level is applied to the heater resistor. The predetermined minimum power density per unit volume is determined by the predetermined minimum power density per unit area divided by the sum of the heater resistor thickness and the protective layer thickness. The printer includes a power supply coupled to the heater resistors for providing the predetermined minimum power level to the heater resistors.

14 Claims, 5 Drawing Sheets

POWER/VOLUME REGIME FOR INK JET PRINTERS

FIELD OF THE INVENTION

The present invention is generally directed to ink jet printers. More particularly, the invention is directed to operating an ink jet print head within a particular power regime to optimize ink nucleation.

BACKGROUND OF THE INVENTION

Thermal ink jet printing involves providing electrical signal impulses to resistive heaters to generate heat, and transferring the heat into adjacently disposed amounts of ink. The heat transferred into the ink causes the ink to nucleate, thereby forming a vapor bubble which propels a droplet of the ink through an adjacent nozzle and onto a printing medium. A number of factors affect the quality of the images produced by a ink jet printer, such as characteristics of the resistive heaters, properties of the ink, and the geometry of the nozzles. All of these factors affect how precisely the ink droplet ejected from the nozzle is placed on the printing medium. Since the print medium and the print head are typically moving with respect to each other as the ink droplet is ejected, the velocity with which the ink droplet is expelled from the nozzle influences the placement of the droplet on the paper. Thus, to maintain good image quality, it is imperative to maintain a stable and predictable droplet velocity.

Therefore, an ink jet printer is needed which maintains stable and predictable ink droplet velocity.

SUMMARY OF THE INVENTION

The foregoing and other needs are met by an ink jet printer that forms printed images by ejecting droplets of ink at a stable velocity onto a print medium. The printer includes an ink jet print head having a plurality of nozzles through which the droplets of ink are ejected. The print head includes a heater chip having a plurality of heating elements, each of which is associated with a corresponding one of the plurality of nozzles. Each heating element transfers heat into adjacent ink at a predetermined rate of heat transfer sufficient to maintain the stable velocity of the droplets of ink, where the predetermined rate of heat transfer is accomplished when a predetermined minimum power level is applied to the heating element.

Each heating element includes a heater resistor and a protective layer adjacent the heater resistor. Each heater resistor has a heater resistor thermal capacitance value, a heater resistor area, and a heater resistor thickness. Each heater resistor is operable to provide a predetermined minimum power density per unit area when the predetermined minimum power level is applied to the heater resistor. The protective layer has a protective layer thermal capacitance value and a protective layer thickness. The heater resistor area multiplied by a sum of the heater resistor thickness and the protective layer thickness represents a heating element volume. Each heating element is operable to provide a predetermined minimum power density per unit volume within the heating element volume when the predetermined minimum power level is applied to an associated heater resistor. According to preferred embodiments of the invention, the predetermined minimum power density per unit volume is determined by the predetermined minimum power density per unit area divided by the sum of the heater resistor thickness and the protective layer thickness.

The printer includes a power supply coupled to the plurality of heater resistors for providing the predetermined minimum power level to the heater resistors. In preferred embodiments of the invention, the power supply provides the predetermined minimum power level sufficient to generate the predetermined minimum power density per unit volume of at least about $1.5\times10^{15}$ watts per cubic meter. By providing a power density per unit volume of at least about $1.5\times10^{15}$ watts per cubic meter in the heating elements of the print head, the invention ensures stable droplet velocity and bubble nucleation quality, thereby enhancing the quality of the printed images.

In another aspect, the invention provides a method for printing with an ink jet printer by ejecting droplets of ink at a stable velocity onto a print medium. The method includes providing a thermal ink jet print head having a plurality of nozzles through which the droplets of ink are ejected. The print head has a heater chip which includes a plurality of heating elements, where each heating element is associated with a corresponding one of the plurality of nozzles. Each heating element in the print head includes a heater resistor having a heater resistor area and a heater resistor thickness, and a protective layer adjacent the heater resistor which has a protective layer thickness. The heater resistor area multiplied by a sum of the heater resistor thickness and the protective layer thickness represents a heating element volume. The method further includes providing a power density per unit volume within the heating element volume of at least about $1.5\times10^{15}$ watts per cubic meter.

In yet another aspect, the invention provides a method for operating a thermal ink jet print head to provide an optimum power density per unit area at a surface of an ink heating resistor within the print head. The method includes providing the thermal ink jet print head having a plurality of nozzles through which droplets of ink are ejected. Within the print head is a heater chip which includes a plurality of heating elements, where each heating element is associated with a corresponding one of the plurality of nozzles. Each heating element includes a heater resistor having a heater resistor thickness $t_R$ and a heater resistor surface area, and a protective layer adjacent the heater resistor which has a protective layer thickness $t_P$. The heater resistor surface area multiplied by the sum of the heater resistor thickness and the protective layer thickness represents a heating element volume. The method further includes providing a power density per unit area $PD_A$ on the heater resistor surface area according to:

$$PD_A=PD_V\times(t_R+t_P),$$

where $PD_V$ represents the power density per unit volume within the heating element volume, which is at least about $1.5\times10^{15}$ watts per cubic meter.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
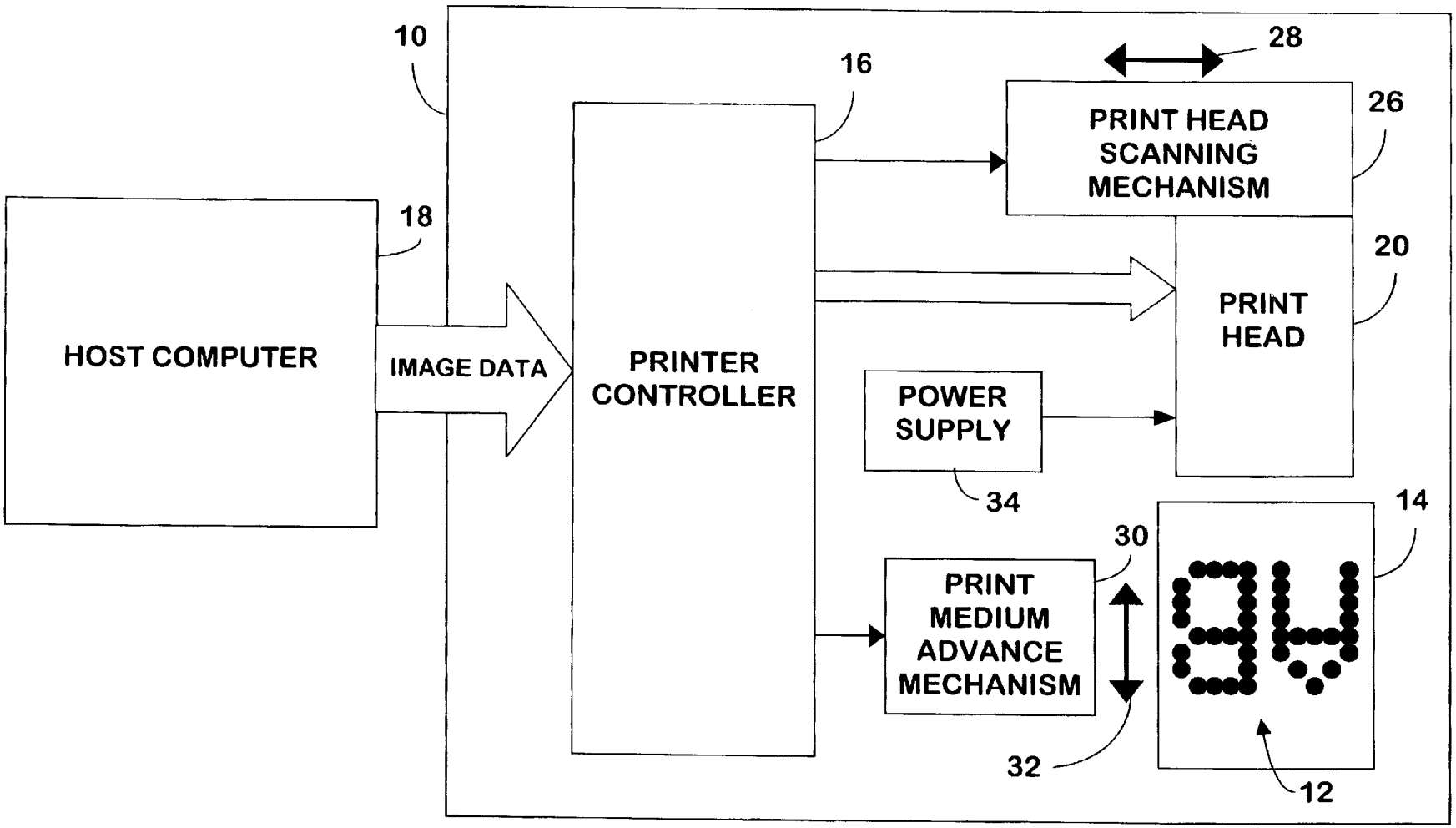
FIG. 1 is a functional block diagram of an ink jet printer according to a preferred embodiment of the invention.

Shown in FIG. 1 is an ink jet printer 10 for printing an image 12 on a print medium 14. The printer 10 includes a printer controller 16, such as a digital microprocessor, that receives image data from a host computer 18. Generally, the image data generated by the host computer 18 describes the image 12 in a bit-map format. Such a format represents the image 12 as a collection of pixels, or picture elements, in a two-dimension rectangular coordinate system. For each pixel, the image data indicates whether the pixel is on or off (printed or not printed), and the rectangular coordinates of the pixel on the print medium 14. Typically, the host computer 18 "rasterizes" the image data by dividing the image 12 into horizontal rows of pixels, stepping from pixel-to-pixel across each row, and writing out the image data for each pixel according to each pixel's order in the row.

Figure 2:
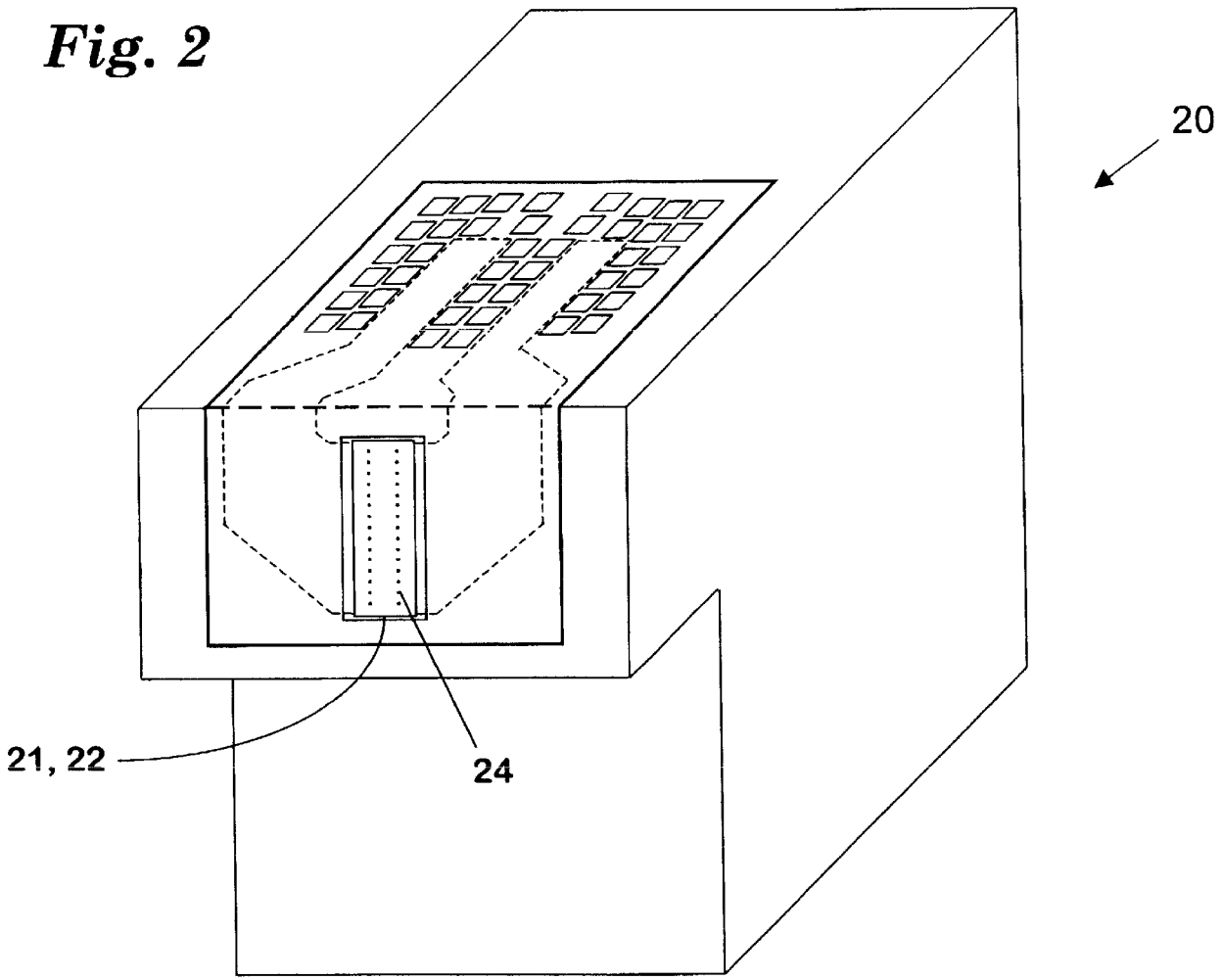
FIG. 2 is an isometric view of an ink jet print head according to a preferred embodiment of the invention.

As shown in FIGS. 1 and 2, the printer 10 includes a print head 20 that receives the print signals from the printer controller 16. On the print head 20 is a thermal ink jet heater chip 21 covered by a nozzle plate 22. Within the nozzle plate 22 are nozzles 24. Based on the print signals from the printer controller 16, ink droplets are ejected from selected ones of the nozzles 24 to form dots on the print medium 14 corresponding to the pixels in the image 12. As described in more detail hereinafter, ink is selectively ejected from a nozzle 24 when a corresponding heating element on the heater chip 21 is activated by the print signals from the controller 16.

With reference to FIG. 1, the printer 10 includes a print head scanning mechanism 26 for scanning the print head 20 across the print medium 14 in a scanning direction as indicated by the arrow 28. Preferably, the print head scanning mechanism 26 consists of a carriage which slides horizontally on one or more rails, a belt attached to the carriage, and a motor that engages the belt to cause the carriage to move along the rails. The motor is driven in response to the commands generated by the printer controller 16.

As depicted in FIG. 1, the printer 10 also includes a print medium advance mechanism 30. Based on print medium advance commands generated by the controller 16, the print medium advance mechanism 30 causes the print medium 14 to advance in a paper advance direction, as indicated by the arrow 32, between consecutive scans of the print head 20. Thus, the image 12 is formed on the print medium 14 by printing multiple adjacent swaths as the print medium 14 is advanced in the advance direction between swaths. In a preferred embodiment of the invention, the print medium advance mechanism 30 is a stepper motor rotating a platen which is in contact with the print medium 14.

As shown FIG. 1, the printer 10 includes a power supply 34 for providing a supply voltage $V_S$ to the print head 20.

Figure 3A:
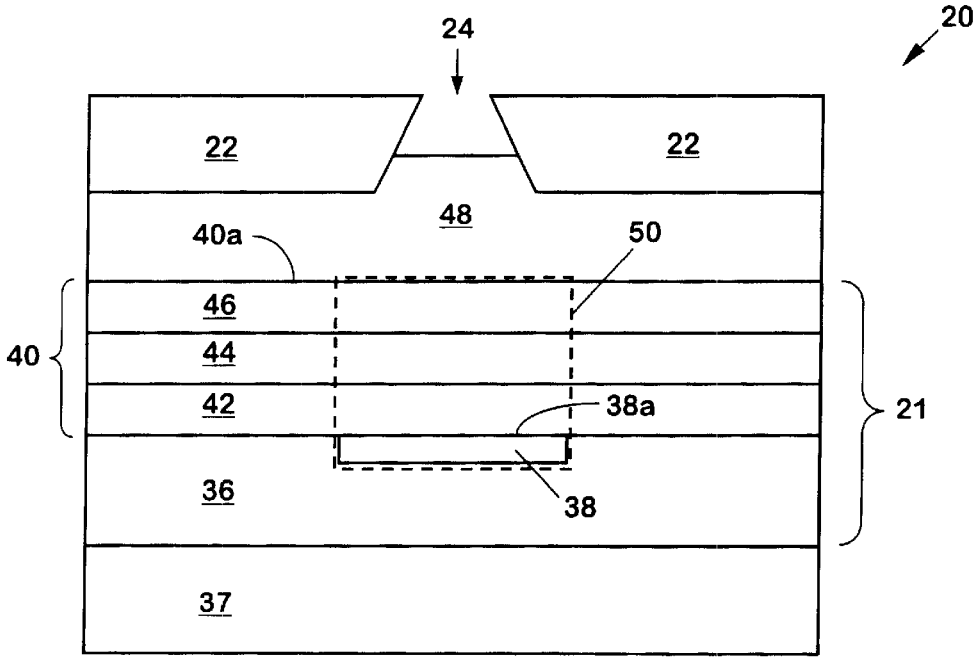
FIG. 3A is a cross-sectional view of a portion of an ink jet print head according to a preferred embodiment of the invention.

FIG. 3A depicts a cross-sectional view of a portion of the heater chip 21 and nozzle plate 22 on the print head 20. The view of FIG. 3A shows one of many heater resistors 38 on the heater chip 21 and one of the nozzles 24 of the nozzle plate 22. The heater chip 21 includes a thermal insulation layer 36 which is preferably formed from a thin layer of silicon dioxide and/or doped silicon glass overlying a relatively thick slab of silicon. The total thickness of the thermal insulation layer 36 is preferably about 1.0 to 2.0 microns. In the preferred embodiment, a silicon substrate layer 37, which is approximately 0.5 to 0.7 millimeters thick, underlies the thermal insulation layer 36. The heater resistor 38 is formed on the thermal insulation layer 36 from an electrically resistive material, such as tantalum-aluminum or tantalum-nitride. The thickness $t_R$ of the heater resistor 38 is most preferably about 900 Å.

Figure 3B:
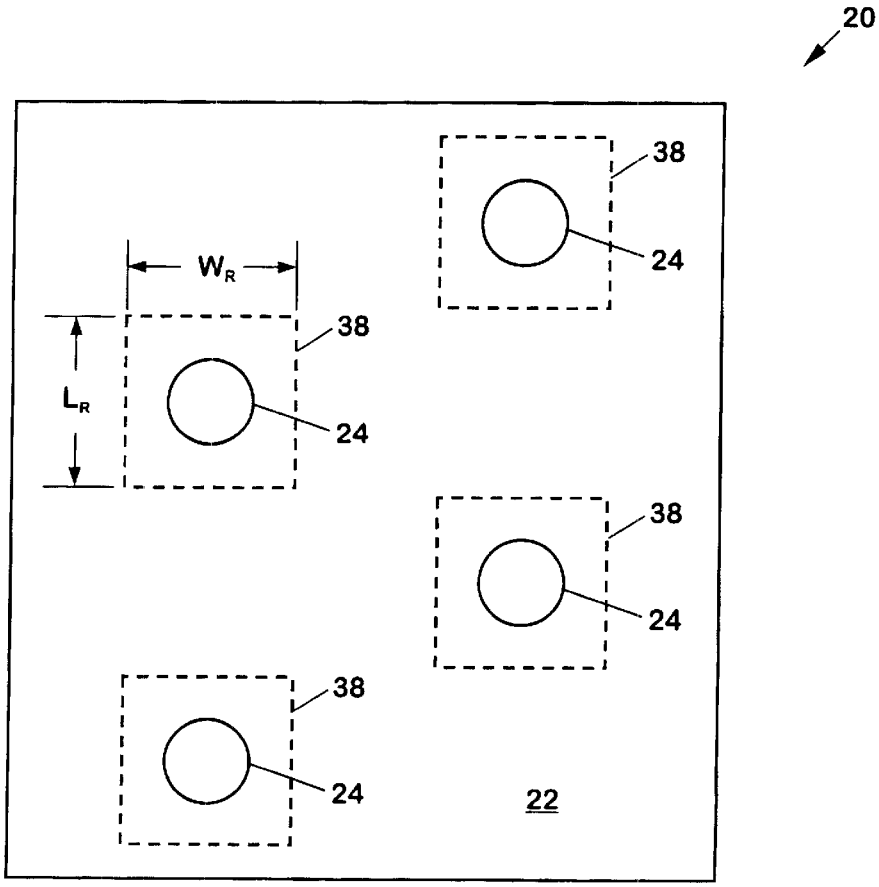
FIG. 3B is a plan view of a portion of an ink jet print head according to a preferred embodiment of the invention.

FIG. 3B shows a plan view of a portion of the heater chip 21 and the nozzle plate 22, and depicts several of the heater resistors 38 (in dashed outline) and their associated nozzles 24. As shown, each heater resistor 38 has a width $W_R$ and a length $L_R$. In a preferred embodiment, $W_R$ is about 14 $\mu$m and $L_R$ is about 37.5 $\mu$, thereby providing a surface area $A_{htr}$ of about 525 $\mu m^2$. In an alternative embodiment, $W_R$ and $L_R$ are about 23 $\mu$m, thereby providing a surface area $A_{htr}$ of about 525 $\mu m^2$. In another embodiment, $W_R$ and $L_R$ are both about 32.5 $\mu$m, providing a heater surface area of about 1056 $\mu m^2$. In yet another embodiment, the heater area is about 306$\mu m^2$. In a further embodiment, the heater area is about 484 $\mu m^2$. As described hereinafter, heaters resistors 38 having areas ranging from about 306 to about 1056 $\mu m^2$, and heating elements 50 comprising a wide variety of materials have a common response to power density per unit volume. Thus, it should be appreciated that the scope of the invention includes, but is not necessarily limited to, any heater area within the range of the discrete values tested.

Overlying the heater resistor 38 is a protective layer 40, which preferably is comprised of several material layers. In the preferred embodiment, the protective layer 40 includes a first passivation layer 42, a second passivation layer 44, and a cavitation layer 46. Preferably, the first passivation layer 42 is formed from a dielectric material, such as silicon nitride, having a thickness of about 4400 Å. The second passivation layer 44 is also preferably a dielectric material, such as silicon carbide, having a thickness of about 2600 Å. These passivation layers may also be formed from a single layer of diamond-like-carbon (DLC). The cavitation layer 46 is preferably formed from tantalum having a thickness of about 5500 Å. The cavitation layer may also be made of TaB, Ti, TiW, TiN, WSi, or any other material with a similar thermal capacitance and high hardness. The thickness $t_P$ of the protective layer 40 is defined as the distance from the top surface 38*a* of the heater resistor 38 to the outermost surface 40*a* of the protective layer 40.

The combination of materials in the protective layer 40 as described above tends to prevent the adjacent ink 48, or other contaminants, from adversely affecting the operation and electrical properties of the heater resistor 38. One skilled in the art will appreciate that many other materials and combinations of materials could be used to form the protective layer 40, some of which are discussed hereinafter. Thus, the invention is not limited to any particular material or combination of materials in the protective layer 40.

As described in more detail below, when electrical power is applied to the heater resistor 38, it generates heat that is transferred through the protective layer 40 and into the adjacent ink 48. In describing this heat transfer process, the heater resistor 38 and the portion of the protective layer 40 overlying the heater resistor 38 (as indicated by the dashed outline in FIG. 3A) are referred to herein as the heating element 50. The volume of the heating element 50 is determined by the area $A_{htr}$ of the heater resistor 38 multiplied by the sum of the thickness $t_R$ of the heater resistor 38 and the thickness $t_P$ of the protective layer 40. For example, the volume of the heating element 50 of a preferred embodiment is about 704 $\mu m^3$. Test data discussed hereinafter (FIG. 5 and Table I) indicate a common ink nucleation response to power density per unit volume for heating element volumes over a range of about 179 $\mu m^3$ to about 1404 $\mu m^3$.

Generally, ink nucleation is defined as the instant in time when the ink 48 adjacent the heating element 50 is transformed from a liquid to a vapor phase. This phase change propels a droplet of the ink 48 away from the heating element 50, through the nozzle 24, and towards the print medium 14. In this disclosure, the phrase "onset of nucleation" refers to the instant in time just prior to ink nucleation.

U.S. Pat. No. 6,132,030 to Cornell, entitled "High Print Quality Thermal Ink Jet Print Head", assigned to Lexmark International, Inc., and incorporated herein by reference, discloses that the time between the application of power to a heater resistor and the onset of nucleation decreases exponentially as power density on the surface of the heater resistor increases. Cornell also describes a relationship between droplet velocity variation, droplet placement variability, and heater power density per unit area. It is shown that at power densities below about 1.2 $GW/m^2$, droplet velocity decreases rapidly and velocity variation increases dramatically. For selected materials, it is shown that velocity variation is substantially eliminated for heater resistor power densities above about 2 $GW/m^2$.

Figure 4:
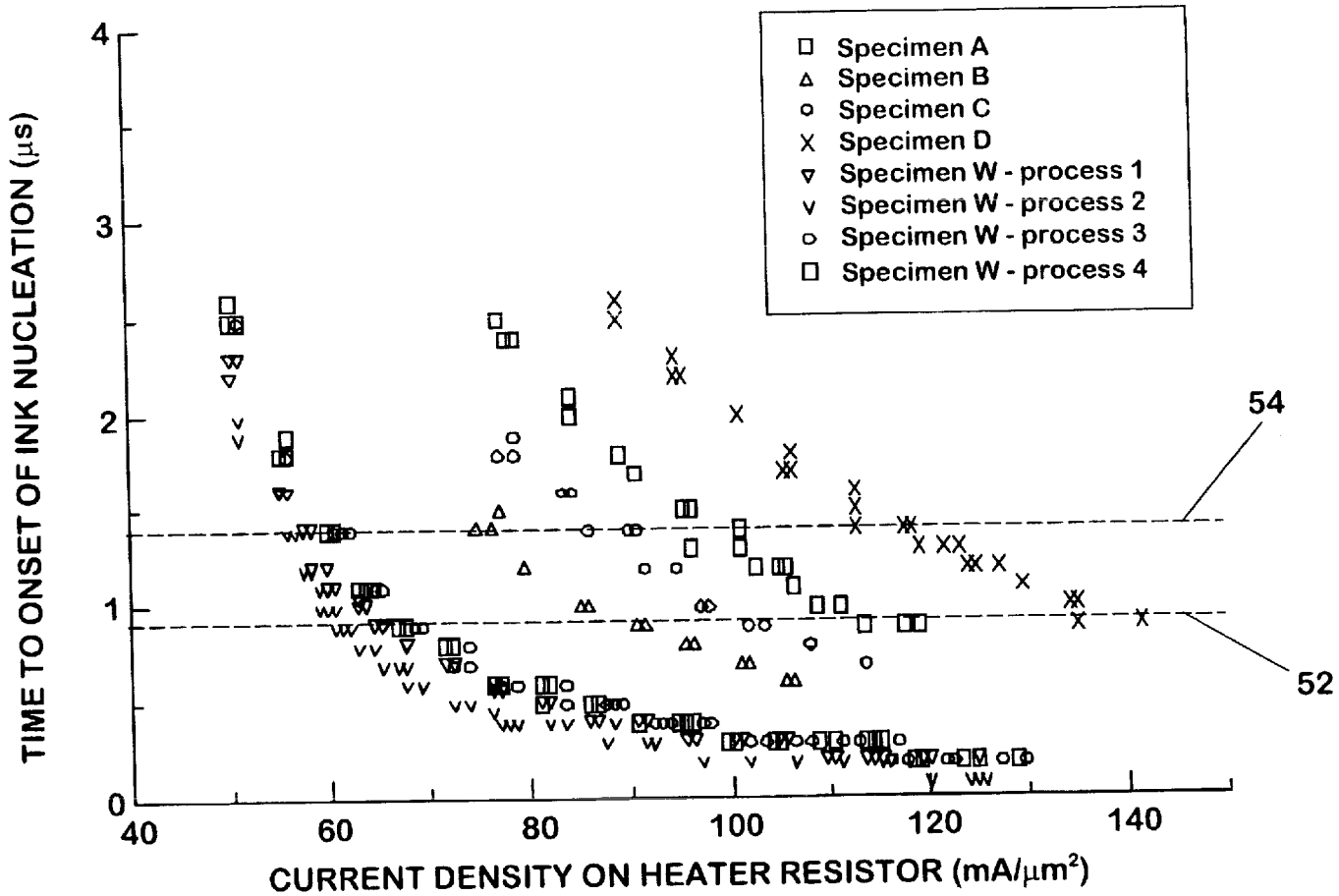
FIG. 4 is a graphical representation depicting a relationship between current density per unit area and the onset of ink nucleation for various combinations of heater chip materials.
Figure 5:
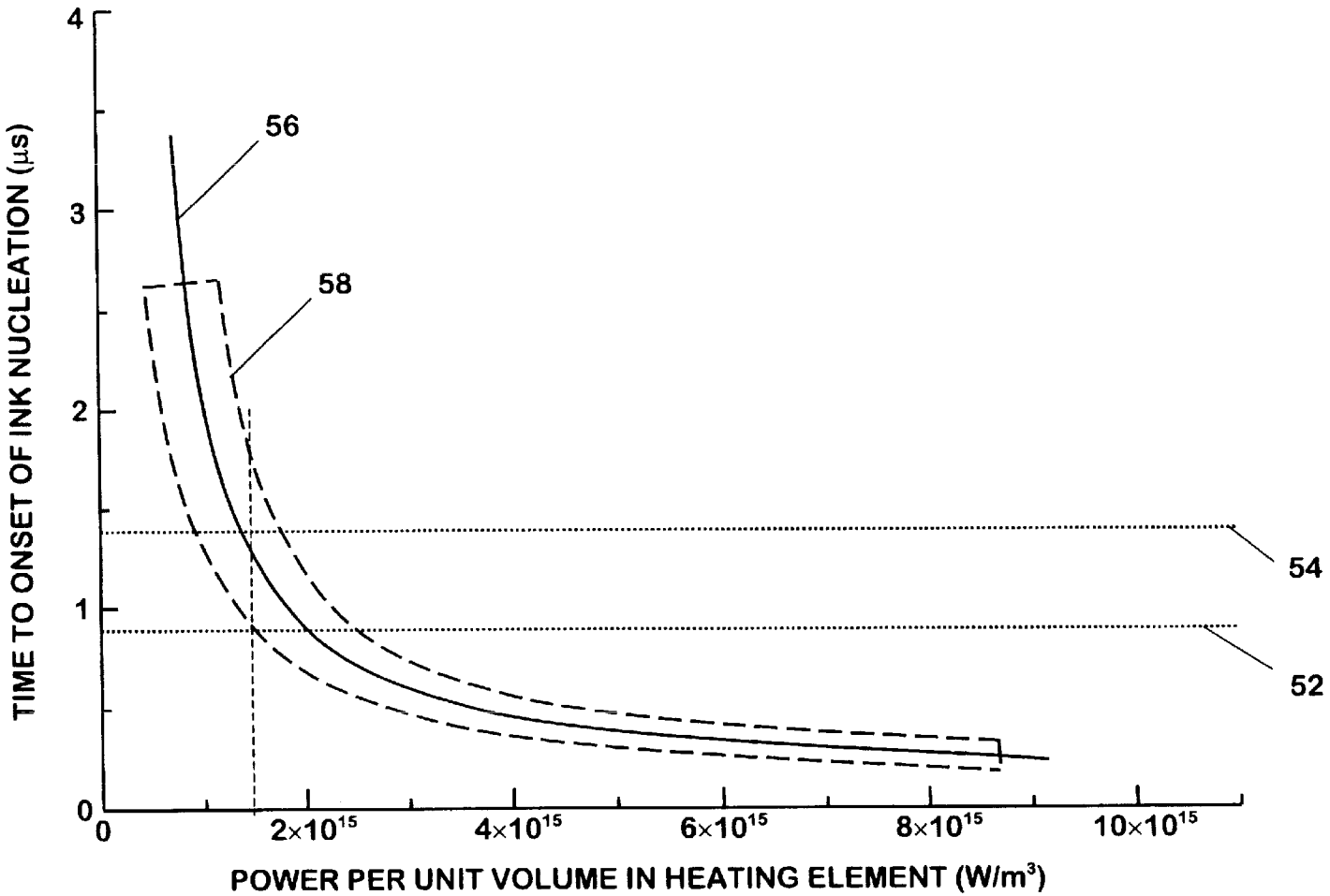
FIG. 5 is a graphical representation depicting a relationship between power density per unit volume and the onset of ink nucleation.

In developing the present invention, a number of thin film experiments and theoretical calculations have provided information useful in further improving the stability of ink droplet velocity in ink jet printers. Depicted in FIGS. 4 and 5 are a number of graphical representations based upon the results of those experiments and calculations, which provide a means to better appreciate the invention. With initial reference to FIG. 4, an empirical relationship between the time to onset of nucleation and current density in the heater resistor 38 (FIG. 3A) is shown. For purposes of the present discussion, current density is defined as the ratio of current through the heater resistor layer 38 divided by the cross sectional area of the heater resistor layer 38 normal to the current flow direction. (It may be illustrative to think of current flow through the resistor being analogous to fluid flow through a pipe.) Thus, the current density J may be expressed as:

$$J = \frac{heater\ current}{W_R \times t_R}. \tag{1}$$

The data of FIG. 4 was measured on a heater resistor 38 formed from tantalum-aluminum, where $t_R$ is approximately 900 Å. For a heater width $W_R$ of 14 microns, the cross sectional area of the heater resistor layer 38 normal to the current flow direction is approximately 1.26 $\mu m^2$. FIG. 4 depicts results measured for various thicknesses and combinations of materials for the layers 42, 44, and 46 (FIG. 3A) comprising the protective layer 40. These and other various combinations are summarized in Table I.

The ordinate of FIG. 4 represents the current density applied to the heater resistor 38 in units of milliamperes per square micrometer. The abscissa represents the time in microseconds from the application of the current to the heater resistor 38 until the onset of ink nucleation. The horizontal line 52 positioned at about 900 nanoseconds delineates a condition of substantially stable ink droplet velocity for very low droplet firing frequencies (not exceeding about 180 Hz). Generally, at such low firing frequencies, the only factor substantially affecting velocity variation is nucleation quality, since ink refill and flooding effects that affect velocity variations at moderate to high frequencies go substantially to zero at very low firing frequencies. In other words, when the time to onset of nucleation is less than about 900 nanoseconds, the low-frequency droplet velocity variation is substantially zero for each type of protective layer 40 that was tested. It is useful to minimize the velocity variation at this low firing frequency because any nucleation induced velocity variations become magnified by meniscus dynamics when the nozzle is fired at high frequency.

As shown in FIG. 4, as current density decreases, a longer time is required to bring the surface temperatures up to a point where stable and homogeneous ink nucleation occurs. Some low-frequency droplet velocity variation is observed for all of the test specimens when the time to onset of nucleation is greater than about 1400 nanoseconds. Thus, the horizontal line 54 delineates the lower limit at which a specific current density introduces low-frequency droplet velocity variations for any of the tested protective layer structures.

As indicated in FIG. 4, to maintain very stable droplet velocity for specimen A, the current density applied to the heater resistor 38 is preferably about 115 $mA/\mu m^2$, and certainly no less than about 95 $mA/\mu m^2$. Operating the heater resistor 38 at current densities higher than this preferred range can lead to premature failure of the resistor 38 due to electromigration. That is, when a tantalum-aluminum film is exposed to high temperatures and high current densities, the aluminum atoms are not tightly held in a metallic bond with the tantalum, so they tend to move downstream with the flow of electrons. As the aluminum atoms migrate, voids are created in areas of the heater 38, while the migratory aluminum atoms pile up elsewhere, tending to cause unpredictable heater characteristics.

A thicker protective layer 40, which may more effectively ward off cavitation erosion, tends to exacerbate the effects of aluminum electromigration. For example, specimen D is representative of the thickest protective layer 40 tested, having an overall thickness of about 16,560 Angstroms (see Table I). As shown in FIG. 4, specimen D required the highest current density to achieve stable bubble nucleation and droplet velocity. At such a high current density, the heater resistors 38 of specimen D failed very rapidly, often within a few seconds, due to the effects of electromigration.

Specimens W, having a diamond-like carbon protective layer 40, required the lowest current density (about 65 $mA/\mu m^2$) to produce very stable droplet velocity.

The current-density-per-unit-area data points of FIG. 4 for each specimen may be converted to power-density-per-unit-volume data points as follows. The power-density-per-unit-area may be expressed as:

$$PD_A = \frac{i_{htr}^2 R_{htr}}{L_R W_R}, \tag{2}$$

where $i_{htr}$ is the current through the heater resistor 38 in Amperes, and $R_{htr}$ is the heater resistance in Ohms. The heater resistance $R^{htr}$ may be expressed as:

$$R_{htr} = R_S \frac{L_R}{W_R}, \tag{3}$$

where $R_S$ is the sheet resistance of the heater resistor 38 in Ohms per square. For $W_R$ equal to $L_R$, the power-density-per-unit-area may be expressed as:

$$PD_A = \frac{i_{htr}^2 R_S}{W_R^2}. \quad (4)$$

The heater current density may be expressed as:

$$J = \frac{i_{htr}}{W_R t_R}, \quad (5)$$

where $t_R$ is the thickness of the heater resistor layer 38. Thus, the power-density-per-unit-area may be express according to:

$$PD_A = (J \times t_R)^2 R_S, \quad (6)$$

and the power-density-per-unit-volume within the heating element 50 may be expressed as:

$$PD_V = \frac{PD_A}{t_R + t_P}, \quad (7)$$

where $t_P$ is the thickness of the protective layer 40.

For example, for $i_{htr}$=118 mA, $t_R$=0.09 μm, $t_P$=0.44+0.26+0.55=1.25 μm, and $W_R$=14 μm, the heater current density is calculated using equation (5):

$$J = \frac{118}{0.09 \times 14} = 94 \ \frac{\text{mA}}{\mu\text{m}^2} = 9.4 \times 10^{10} \ \frac{\text{A}}{\text{m}^2},$$

the power-density-per-unit-area is calculated using equation (6):

$$PD_A = (9.4 \times 10^{10})^2 (0.09 \times 10^{-6})^2 (28.2)$$
$$= 2.0 \times 10^9 \ \frac{\text{Watts}}{\text{m}^2} = 2.0 \ \frac{\text{GW}}{\text{m}^2},$$

and the power-density-per-unit-volume is calculated using equation (7):

$$PD_V = \frac{2.0 \times 10^9}{(0.09 \times 10^{-6}) + (1.25 \times 10^{-6})} = 1.5 \times 10^{15} \ \frac{\text{Watts}}{\text{m}^3}.$$

As depicted in FIG. 5, if all of the data points for $PD_V$ versus time to onset of bubble nucleation are plotted for all of the print head specimens tested (see Table I), the data points all fall within the dashed boundary 58.

The curve 56 in FIG. 5 illustrates the result of simulations performed using a heat transfer-phase change computer model, which predicts heat transfer and phase change based on the material properties and drive pulse conditions provided to the model. More theoretical background information on computing the onset of nucleation by the bubble reliability method is discussed in U.S. Pat. No. 6,132,030.

Thus, FIG. 5 illustrates an empirical relationship between the time to onset of bubble nucleation and power per unit volume applied to the heating element 50, where the volume of the heating element 50 is defined as the surface area of the heater resistor 38 multiplied by the sum of the thickness $t_R$ of the heater resistor 38 and the thickness $t_P$ of the protective layer 40. FIG. 5 indicates that a good first order approximation of the power per unit volume required to maintain stable droplet velocity and bubble nucleation quality is at least about $1.5 \times 10^{15}$ Watts/m$^3$. This preferred power regime is consistent with the area power density of 2 GW/m$^2$ disclosed in U.S. Pat. No. 6,132,030. Thus, according to a most preferred embodiment of the invention, the power supply 34 provides the supply voltage $V_S$ at a level which results in a power per unit volume within the heating element 50 of at least about $1.5 \times 10^{15}$ Watts/m$^3$ for the various materials discussed herein and materials having similar thermal capacitances and/or properties.

For heating element materials having thermal capacitances in the range of about $2.1 \times 10^6$ to $3.2 \times 10^6$ Joules/Kelvin-meter$^3$, the relationship between power density per unit area on the surface of the heater resistor 38 and power density per unit volume within the heating element 50 may be expressed as:

$$PD_A = PD_V \times (t_R + t_P). \quad (8)$$

As discussed above, since it is desirable to maintain a power density per unit volume within the volume of the heating element 50 of at least about $1.5 \times 10^{15}$ Watts/m$^3$, the desired power density per unit area may be determined according to:

$$PD_A \geqq (1.5 \times 10^{15} \ \text{W/m}^3) \times (t_R + t_P). \quad (9)$$

Thus, if the thickness $t_R$ of the heater resistor 38 and the thickness $t_P$ of the protective layer 40 are known, the minimum desired power density per unit area on the surface of the heater resistor 38 may be calculated. For example, if the thickness $t_R$ of the heater resistor 38 is 900 Å and the total thickness $t_P$ of the protective layer 40 is 12500 Å, the desired minimum power density per unit area on the surface of the heater resistor 38 is:

$$PD_A \geqq (1.5 \times 10^{15} \ \text{W/m}^3) \times (900 + 12500) \times 10^{-10} \ \text{m} \geqq 2.0 \times 10^9 \ \text{W/m}^2. \quad (10)$$

For a heater resistor surface area of 525 μm$^2$, the power applied to the heater resistor 38 is:

$$2.0 \times 10^9 \ \text{W/m}^2 \times 525 \ \mu\text{m}^2 \times \text{m}^2 / 10^{12} \ \mu\text{m}^2 = 1.05 \ \text{W}. \quad (11)$$

For a heater resistor 38 having a resistance of 28 Ω, the desired current through the heater resistor 38 is:

$$I_R = \sqrt{\frac{1.05 \ \text{W}}{28 \ \Omega}} = 194 \ \text{mA}. \quad (12)$$

Taking into account other resistive losses between the power supply 34 and the heater resistor 38, the voltage level $V_S$ provided by the power supply 34 should be set to provide the current of equation (12) through the heater resistor 38.

The materials comprising the protective layer 40 used in gathering the data of FIG. 5 include combinations of SiN, SiC, and Ta, as described above, four versions of DLC, and various other materials as listed in Table I. The thickness of the protective layer 40 in the specimens of Table I ranged from about 2500 angstroms to about 16560 angstroms.

All of the specimens listed in Table I had resistors 38 comprising TaAl, except for specimen Y which has a resistor 38 comprising TaN.

The specimens listed in Table I also include four discrete sizes and shapes of the heater resistor 38. For specimens A through z in Table I, $L_R$=37.5 $\mu$m and $W_R$=14 $\mu$m, resulting in heater areas of 525 $\mu m^2$. For specimens ω, α, and Δ, $L_R$=$W_R$=32.5 $\mu$m, resulting in heater areas of 1056 $\mu m^2$. Specimen 1 has a heater area of 306 $\mu m^2$, and specimen 2 has a heater area of 484 $\mu m^2$. Thus, in the specimens listed in Table I, the heater area ranges from about 306 to about 1056 $\mu m^2$.

As shown in FIG. 5, regardless of the heater material, heater area, protective layer material, or protective layer area, all of the data follows a similar response when plotting onset of nucleation as a function of power density per unit volume. The commonality of this response, that has been shown to be independent of heater shape, area and materials, begs for a fundamental explanation which the inventor provides below. It should be appreciated, however, that the invention is not limited to any particular theory of operation.

The material in Table I having the lowest thermal conductivity is silicon nitride at about 16 W/m-K. The material in the table having the highest thermal conductivity is DLC at about 1200 W/m-K. The thermal conductivity of these two materials covers a range of about 75 to 1. While the thermal conductivity of the materials in Table I varies over a wide range, the thermal capacitance values do not. Thermal capacitance effects go to zero in steady state heat transfer conditions, but thermal ink jet is not a steady state heat transfer condition. In a thermal ink jet device, the temperature transients are on the order of $10^8$–$10^9$ degrees Kelvin per second when power is applied to heater resistor 38. Thermal capacitance effects are very important in such transient heat transfer conditions.

To understand how transient heat transfer effects the heater resistor 38 and the overlying layers 42, 44, and 46, the thermal capacitance of the various materials must be included in the analysis. Thermal capacitance is defined as the product of the material's density multiplied by the material's specific heat. Every time the heater resistor 38 is pulsed with a finite amount of electrical energy, the heater resistor 38 transforms the electrical energy into heat. The objective is to create a thermal boundary layer in the ink 48 at the upper surface 40*a* of the heating element 50. The thermal energy in the superheated portion of the thermal boundary layer is the fuel for the liquid-vapor phase change, i.e. the formation of the bubble.

Before reaching the ink 48, the heat or thermal energy must pass through the layers 42, 44, and 46, each of which reduces the amount of heat transferred to the ink 48. That is, every molecule in the heater resistor 38 and the layers 42, 44, and 46 must be heated on each and every ink ejection pulse. To create a thermal boundary layer in the ink 48, each molecule in the heater resistor 38 and the adjacent overlying layers 42, 44, and 46 must be supplied with a finite amount of energy just to heat the thin films. Thus, the energy required to eject an ink droplet from a nozzle 24 is related to the volume of the heating element 50 and the specific beat of the materials that comprise the heating element 50.

The amount of energy required to raise the temperature of a thin solid film is a function of the film's thermal capacitance. It has been determined that the product of a material's specific heat and atomic weight are approximately constant for many solid elements. According to the law of Dulong and Petit, it takes approximately $10^{-26}$ kcal per atom to raise the temperature of most solid elements by 1 degree Kelvin.

TABLE I

| | Layer 42 | | Layer 44 | | Layer 46 | | Total |
|---|---|---|---|---|---|---|---|
| Specimen | Material | Thickness (Å) | Material | Thickness (Å) | Material | Thickness (Å) | Thickness (Å) |
| A | SiN | 4330 | SiC | 2564 | Ta | 5286 | 12180 |
| B | SiN | 3577 | — | — | Ta | 3321 | 6898 |
| C | SiN | 2994 | SiC | 5279 | — | — | 8273 |
| D | SiN | 5752 | SiC | 5936 | Ta | 4872 | 16560 |
| E | DLC | 2500 | — | — | — | — | 2500 |
| F | DLC | 2500 | — | — | — | — | 2500 |
| G | SiN | 1500 | SiC | 4102 | Ta | 2583 | 8185 |
| H | SiN | 3713 | SiC | 3048 | Ta | 4176 | 10937 |
| I | DLC | 2500 | — | — | — | — | 2500 |
| J | DLC | 2500 | — | — | — | — | 2500 |
| K | SiN | 4330 | SiC | 2564 | Ta | 5286 | 12180 |
| L | SiN | 5797 | SiN | 2753 | — | — | 8550 |
| M | SiN | 1407 | SiC | 5725 | Ta | 8016 | 15148 |
| N | SiN | 5678 | SiC | 366 | Ta | 7775 | 13819 |
| O | SiN | 1388 | — | — | Ta | 7391 | 8779 |
| P | SiN | 3686 | SiC | 2985 | Ta | 3766 | 10437 |
| Q | SiN | 3974 | SiC | 3922 | Ta | 8316 | 16212 |
| R | SiN | 4400 | SiC | 2600 | Ta-0-5% B | 8500 | 15500 |
| S | SiN | 4400 | SiC | 2600 | Ta-10% B | 8500 | 15500 |
| T | SiN | 4400 | SiC | 2600 | Ta-15% B | 8500 | 15500 |
| U | SiN | 4400 | SiC | 2600 | TiW | 6000 | 13000 |
| V | SiN | 4400 | SiC | 2600 | TiN | 6000 | 13000 |
| W | DLC | 4000 | — | — | — | — | 4000 |
| X | SiC | 4000 | — | — | — | — | 4000 |
| Y | SiN | 4400 | SiC | 2600 | Ta | 5500 | 12500 |
| Z | SiN | 4535 | SiC | 2442 | WSi | 6000 | 12977 |
| z | SiN | 4535 | SiC | 2400 | Ti | 8000 | 14935 |
| ω | SiN | 4400 | SiC | 2600 | Ta | 5400 | 12400 |
| α | SiN | 6700 | — | — | Ta | 3900 | 10600 |
| Δ | SiN | 6700 | — | — | Ta | 2400 | 9100 |
| 1 | SiN | 2540 | SiC | 1150 | Ta | 4763 | 8453 |
| 2 | SiN | 2540 | SiC | 1150 | Ta | 4763 | 8453 |

Since it is logical that density is related to atomic weight, it is also logical that the relationship between density and specific heat would be nearly constant for most solid elements. Table II shows that this is indeed true for the materials discussed above, as well as for other materials commonly used in ink jet print head heater chips. Thus, materials having similar thermal capacitances follow a common onset of nucleation response according to the power applied per unit volume as depicted by the curve 56 in FIG. 5.

TABLE II

| Material | Thermal capacitance ($J/K\text{-}m^3$) |
|---|---|
| Ta | $2.29 \times 10^6$ |
| TaC | $2.66 \times 10^6$ |
| TaB | $2.71 \times 10^6$ |
| Pt | $2.89 \times 10^6$ |
| Ag | $2.48 \times 10^6$ |
| Ti | $2.35 \times 10^6$ |
| W | $2.58 \times 10^6$ |
| Wsi | $2.89 \times 10^6$ |
| TiN | $3.15 \times 10^6$ |
| Al | $2.43 \times 10^6$ |
| SiC | $2.14 \times 10^6$ |
| SiN | $2.38 \times 10^6$ |
| TaAl | $2.63 \times 10^6$ |
| DLC | $2.20 \times 10^6$ |
| Cr | $3.15 \times 10^6$ |
| Au | $2.49 \times 10^6$ |
| Pd | $2.97 \times 10^6$ |
| V | $3.06 \times 10^6$ |
| Re | $2.89 \times 10^6$ |
| Zn | $2.75 \times 10^6$ |

As FIG. 5 indicates, there is no significant advantage in applying more than about $2.3\times10^{15}$ $W/m^3$ to the heating element, i.e. operating in a power regime below the line 52. In fact, operating above about $2.5\times10^{15}$ $W/m^3$ may significantly shorten the operational lifetime of the print head, due to degradation of the heater resistors 38 brought on by electromigration. For example, in a long term life test performed on a group of print heads having heating elements 50 consisting of 900 Å of TaAl, 3577 Å of silicon nitride, and 3321 Å of tantalum, which were powered with $2.5\times10^{15}$ $W/m^3$, the print heads began to fail at 250 million fires. A second group of print heads were powered with $1.7\times10^{15}$ $W/m^3$, and the mean-time-to-failure (MTTF) was increased to 416 million fires. In these tests, the ink and heater energy were kept constant to avoid confounding the effect of power per unit volume on life.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. An ink jet printer for forming printed images by ejecting droplets of ink at a stable velocity onto a print medium, the printer comprising:

an ink jet print head comprising:

a plurality of nozzles through which the droplets of ink are ejected; and a heater chip comprising:

a plurality of heating elements, each associated with a corresponding one of the plurality of nozzles, each heating element for transferring heat into adjacent ink at a predetermined rate of heat transfer sufficient to maintain the stable velocity of the droplets of ink, where the predetermined rate of heat transfer is accomplished when a predetermined minimum power level is applied to the heating element, each heating element comprising:

a heater resistor having a heater resistor thermal capacitance value, a heater resistor area, and a heater resistor thickness, the heater resistor operable to provide a predetermined minimum power density per unit area when the predetermined minimum power level is applied to the heater resistor; and a protective layer adjacent the heater resistor, the protective layer having a protective layer thermal capacitance value and a protective layer thickness, where the heater resistor area multiplied by a sum of the heater resistor thickness and the protective layer thickness represents a heating element volume, where each heating element is operable to provide a predetermined minimum power density per unit volume within the heating element volume when the predetermined minimum power level is applied to an associated heater resistor, the predetermined minimum power density per unit volume determined by the predetermined minimum power density per unit area divided by the sum of the heater resistor thickness and the protective layer thickness; and a power supply coupled to the plurality of heater resistors for providing the predetermined minimum power level to the heater resistors.

2. The ink jet printer of claim 1 wherein the power supply provides the predetermined minimum power level sufficient to generate the predetermined minimum power density per unit volume of at least about $1.5\times10^{15}$ watts per cubic meter.

3. The ink jet printer of claim 2 wherein the power supply provides the predetermined minimum power level sufficient to generate the predetermined minimum power density per unit volume of no greater than about $3.0\times10^{15}$ watts per cubic meter.

4. The ink jet printer of claim 1 wherein the heater resistor thermal capacitance value and the protective layer thermal capacitance value are within a range of about $2.1\times10^6$ to about $3.2\times10^6$ Joules/Kelvin-meter$^3$.

5. The ink jet printer of claim 1 wherein the heater resistor area is about 306 $\mu m^2$ to 1056 $\mu m^2$ and the heater resistor thickness is about 900 Å.

6. The ink jet printer of claim 1 wherein the protective layer thickness is within a range of about 2500 Å to about 16600 Å.

7. The ink jet printer of claim 1 wherein the protective layer comprises multiple layers of material.

8. The ink jet printer of claim 1 wherein the protective layer is formed of one or more materials selected from the group consisting of silicon-nitride (SiN), silicon-carbide (SiC), tantalum (Ta), titanium-tungsten (TiW), diamond-like carbon (DLC), tantalum-boride (TaB), titanium-nitride (TiN), titanium (Ti), and tungsten-silicon (WSi).

9. The ink jet printer of claim 1 wherein the heater resistor is formed of one or more materials selected from the group consisting of tantalum-aluminum (TaAl) and tantalum-nitride (TaN).

10. An ink jet printer for forming printed images by ejecting droplets of ink at a stable velocity onto a print medium, the printer comprising:

an ink jet print head comprising:

a plurality of nozzles through which the droplets of ink are ejected; and a heater chip comprising:

a plurality of heating elements, each associated with a corresponding one of the plurality of nozzles, each heating element for transferring heat into adjacent ink at a predetermined rate of heat transfer sufficient to maintain the stable velocity of the droplets of ink, where the predetermined rate of heat transfer is accomplished when a predetermined minimum power level is applied to the heating element, each heating element comprising:

a heater resistor having a heater resistor thermal capacitance value within a range of about $2.1\times10^6$ to about $3.2\times10^6$ Joules/Kelvin-meter$^3$, a heater resistor area, and a heater resistor thickness, the heater resistor operable to provide a predetermined minimum power density per unit area when the predetermined minimum power level is applied to the heater resistor; and a protective layer adjacent the heater resistor, the protective layer having a protective layer thermal capacitance value within a range of about $2.1\times10^6$ to about $3.2\times10^6$ Joules/Kelvin-meter$^3$ and a protective layer thickness, where the heater resistor area multiplied by a sum of the heater resistor thickness and the protective layer thickness represents a heating element volume, where each heating element is operable to provide a predetermined minimum power density per unit volume within the heating element volume when the predetermined minimum power level is applied to an associated heater resistor, the predetermined minimum power density per unit volume determined by the predetermined minimum power density per unit area divided by the sum of the heater resistor thickness and the protective layer thickness; and a power supply coupled to the plurality of heater resistors for providing the predetermined minimum power level sufficient to generate the predetermined minimum power density per unit volume of at least about $1.5\times10^{15}$ watts per cubic meter and no greater than about $3.0\times10^{15}$ watts per cubic meter.

11. A method for printing with an ink jet printer by ejecting droplets of ink at a stable velocity onto a print medium, comprising:

(a) providing a thermal ink jet print head having a plurality of nozzles through which the droplets of ink are ejected, and having a heater chip which includes a plurality of heating elements, each heating element associated with a corresponding one of the plurality of nozzles, each heating element comprising a heater resistor having a heater resistor area and a heater resistor thickness, and a protective layer adjacent the heater resistor having a protective layer thickness, where the heater resistor area multiplied by a sum of the heater resistor thickness and the protective layer thickness represents a heating element volume; and (b) providing a power density per unit volume within the heating element volume of at least about $1.5\times10^{15}$ watts per cubic meter.

12. The method of claim 11 wherein step (b) further comprises providing a power density per unit volume within the heating element volume of no more than about $3.0\times10^{15}$ watts per cubic meter.

13. A method for operating a thermal ink jet print head to provide an optimum power density per unit area at a surface of an ink heating resistor within the print head, the method comprising:

(a) providing the thermal ink jet print head having a plurality of nozzles through which droplets of ink are ejected, and having a heater chip which includes a plurality of heating elements, each heating element associated with a corresponding one of the plurality of nozzles, each heating element comprising a heater resistor having a heater resistor thickness $t_R$ and a heater resistor surface area, and a protective layer adjacent the heater resistor having a protective layer thickness $t_P$, where the heater resistor surface area multiplied by a sum of the heater resistor thickness and the protective layer thickness represents a heating element volume;

(b) providing a power density per unit area $PD_A$ on the heater resistor surface area of about:

$$PD_A=PD_V\times(t_R+t_P),$$

where $PD_V$ is a power density per unit volume of at least about $1.5\times10^{15}$ watts per cubic meter.

14. The method of claim 13 wherein $PD_V$ is less than about $3.0\times10^{15}$ watts per cubic meter.

* * * * *